US007213895B2

(12) United States Patent
Wu

(10) Patent No.: US 7,213,895 B2
(45) Date of Patent: May 8, 2007

(54) FOLDABLE BOOKCASES

(75) Inventor: Chieh-Ly Wu, Chang Hua Hsien (TW)

(73) Assignee: Haw Jou Enterprise Co., Ltd., Chang Hua Hsien (TW)

( * ) Notice: Subject to any disclaimer, the term of this patent is extended or adjusted under 35 U.S.C. 154(b) by 210 days.

(21) Appl. No.: 11/146,022

(22) Filed: Jun. 7, 2005

(65) Prior Publication Data

US 2006/0226744 A1 Oct. 12, 2006

(30) Foreign Application Priority Data

Apr. 12, 2005 (TW) ..... 94205680 U

(51) Int. Cl.
*A47B 43/00* (2006.01)

(52) U.S. Cl. ..... 312/258

(58) Field of Classification Search ..... 312/258, 312/262, 257.1, 263; 108/115
See application file for complete search history.

(56) References Cited

U.S. PATENT DOCUMENTS 442,664 A * 12/1890 Elsner ..... 312/262
3,006,709 A * 10/1961 Krey ..... 312/262
3,955,864 A * 5/1976 MacDonald et al. ..... 312/258
4,482,195 A * 11/1984 Chapin ..... 312/210
6,039,418 A * 3/2000 Thomas ..... 312/258
6,113,203 A * 9/2000 Chen ..... 312/258
6,722,750 B2 * 4/2004 Chan ..... 312/258
2005/0067926 A1 * 3/2005 Chiang ..... 312/258

* cited by examiner

*Primary Examiner*—Janet M. Wilkens
(74) *Attorney, Agent, or Firm*—Bacon & Thomas, PLLC

(57) ABSTRACT

A foldable bookcase includes a frame with two sidewalls pivotably connected to two vertical sides of the frame and a top board and a bottom board are pivotably connected to the top side and the bottom side of the frame. The top board, the bottom board and the two sidewalls are pivotable relative to the frame. The top board includes bosses which are engaged with holes in the sidewalls. A rear board are fixed to the top board by a bolt and stops extend from an inside of the rear board so as to be in contact with L-shaped bent edge defined in the rear side of each of the sidewalls. By this arrangement, the bookcase is easily assembled and the pivotable top board, bottom board and two sidewalls allow the bookcase to be folded into a compact size.

4 Claims, 10 Drawing Sheets

FOLDABLE BOOKCASES

FIELD OF THE INVENTION

The present invention relates to a foldable bookcase which can be easily assembled and folded into a compact size.

BACKGROUND OF THE INVENTION

Conventional bookcases are made to be a one-piece structure which includes a top board, a bottom board, two sidewalls and one or two front doors. All of the parts are fixedly by nails (for wood boards) or by way of welding (for metal boards). The conventional bookcases are not convenient to be transported and occupy a lot of space which increases cost for the manufactures. As shown in FIGS. 9 and 10, a conventional foldable bookcase 80 includes a front frame 81, a rear board 83, a foldable top board 85 and a foldable bottom board 86 both are connected between the front frame 81 and the rear board 83, two sidewalls 82 and two doors 84. Each of the top board 85 and the bottom board 86 is composed of two parts 87 which are pivotably connected to each other by pivots 871 and can be folded along the connection side located at a center of the top board 85 and the bottom board 86. The other side opposite to the connection side of each of the top board 85 and the bottom board 86 are pivotably connected to the front frame 81 and the rear board 83 by connection pieces 872. The two ends of each of the parts 87 include L-shaped engaging plates 88 which are connected to holes 821 of the sidewalls 82. Therefore, the bookcase 80 can be folded into a compact size by folding the top board 85 and the bottom board 86.

Nevertheless, the folding line, i.e. the connection side is exposed and can be seen from outside of the bookcase 80 and the engaging plates 88 need extra machining processes to be made on the parts 27 of the top board 85 and the bottom board 86. The engaging plates 88 protrude from the parts 27 and exposed so that the bookcase 80 cannot meet requirements of aesthetic purposes.

The present invention intends to provide a foldable bookcase wherein the top board, the bottom board and the two sidewalls can be folded relative to the front frame. Besides, the bookcase of the present invention has no folding lines and engaging plats can be seen from outside of the bookcase.

SUMMARY OF THE INVENTION

The present invention relates to a foldable bookcase that comprises a frame including a top side, a bottom side and two vertical sides connected between the top side and the bottom side. A top board has a first edge plate bent from a front side and two ends of the top board and a first connection portion is bent from a rear side of the top board. The front side of the top board is pivotably connected to the top side of the frame by first pivotable members. A bottom board has a second edge plate bent from a front side and two ends of the bottom board, and a second connection portion is bent from a rear side of the bottom board. The front side of the bottom board is pivotably connected to the bottom side of the frame by second pivotable members. Two sidewalls each have a bent plate extending from a top side, a front side and a bottom side thereof. The two respective front sides of the two sidewalls are pivotably connected to the two vertical sides of the frame by third pivotable members. An L-shaped bent edge is defined in a rear side of each of the sidewalls. A rear board has an inward bent L-shaped connection portion on a top side thereof and an insertion extends from a bottom side and two vertical sides of the rear board. The L-shaped connection portion of the rear board is connected to the a first connection portion of the top board and the insertion on the bottom side and the two vertical sides of the rear board are respectively connected to the bottom side of the frame and the two L-shaped grooves of the two sidewalls.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 1-1 shows connection of the sidewall and the top board;

FIG. 6-1 shows an enlarged cross sectional view of the connection of the rear board and the sidewall;

DETAILED DESCRIPTION OF THE PREFERRED EMBODIMENT

Figure 1:
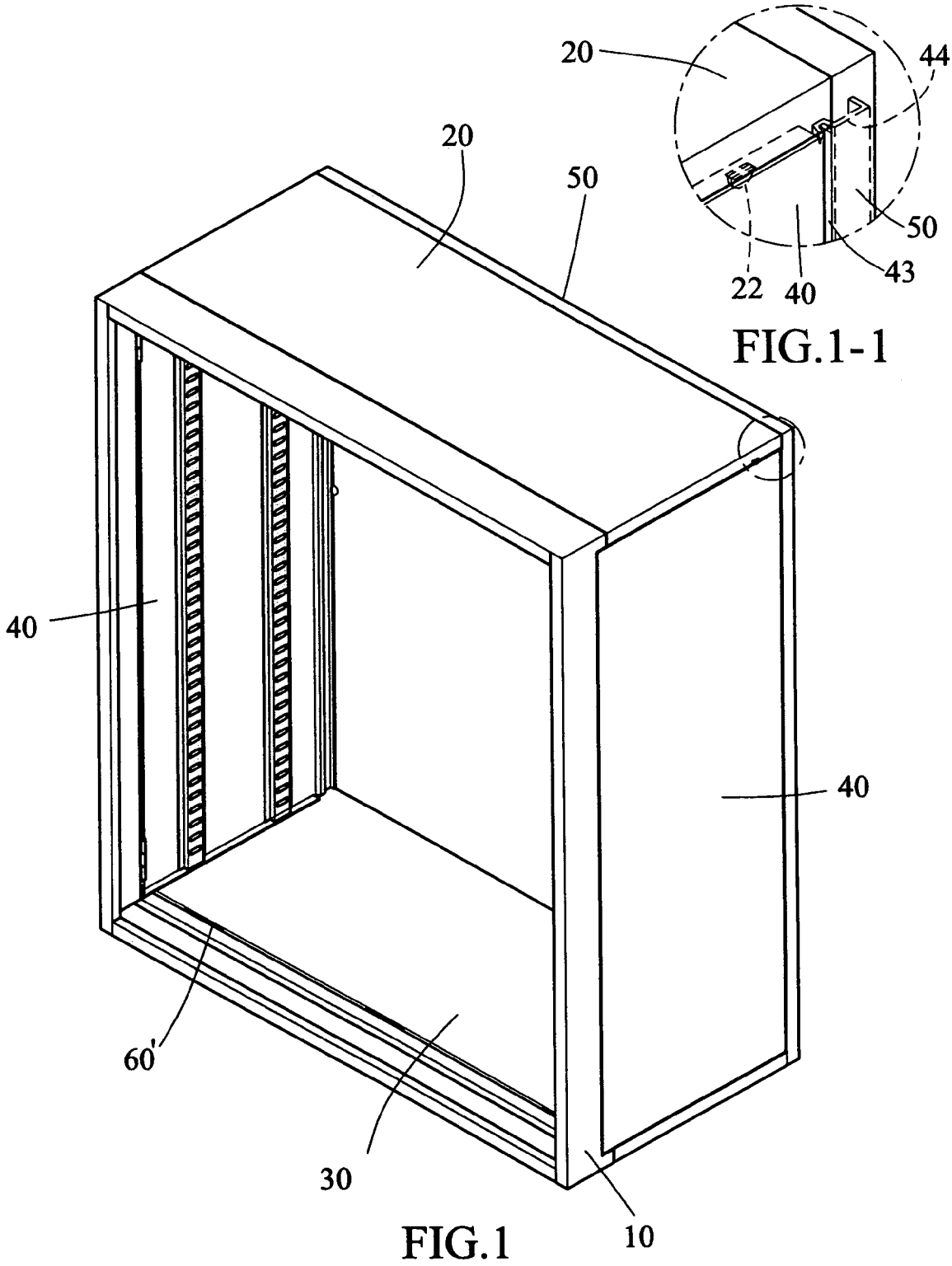
FIG. 1 is a perspective view to show the bookcase of the present invention.
Figure 2:
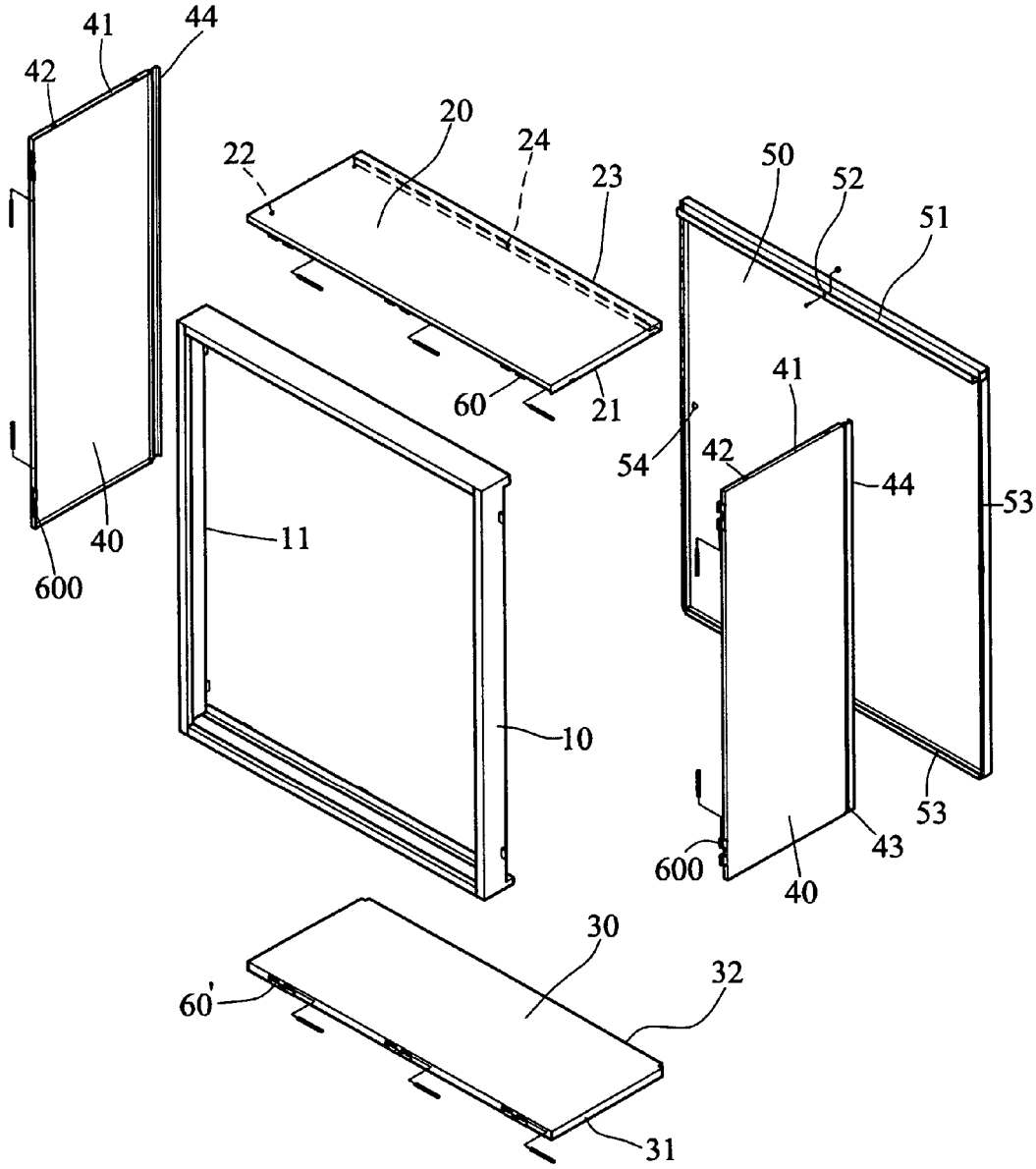
FIG. 2 is an exploded view to show the bookcase of the present invention.
Figure 3:
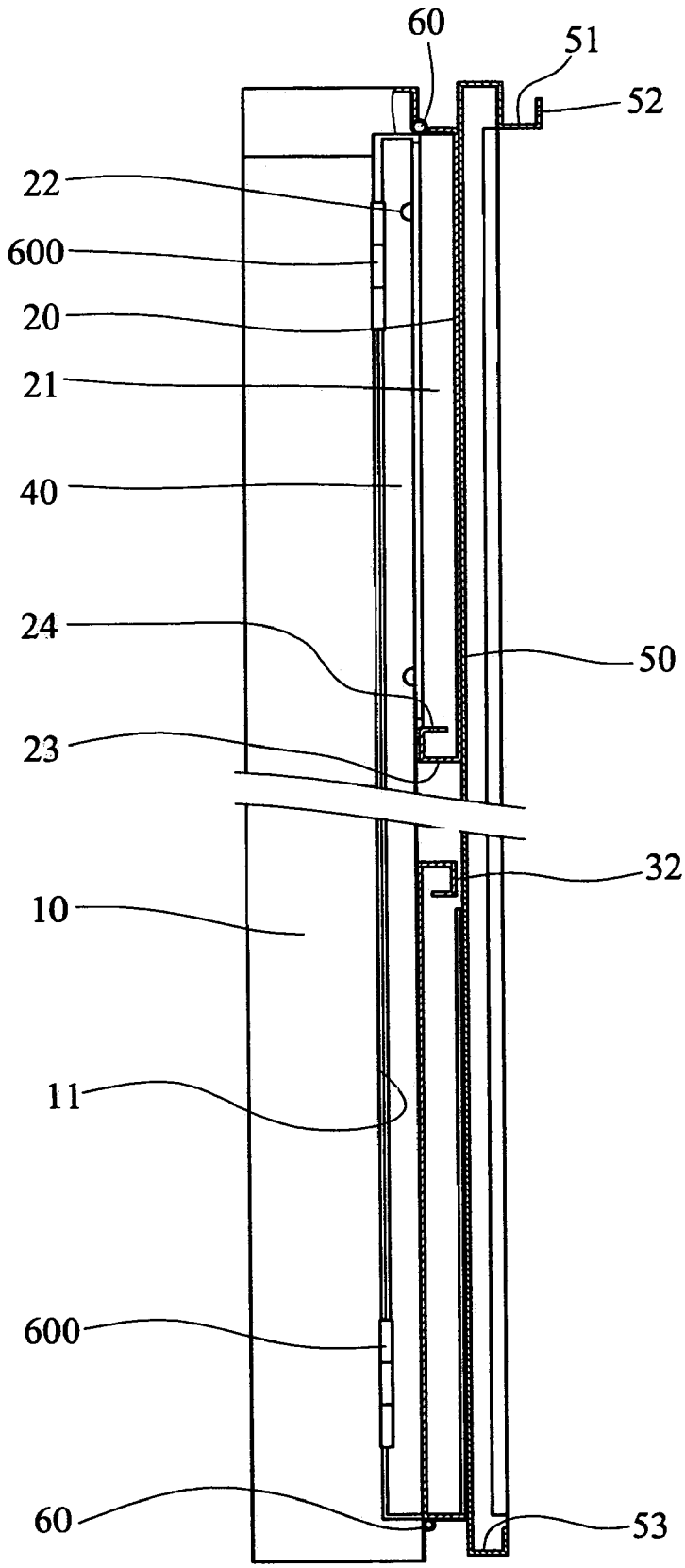
FIG. 3 shows the folded status of the bookcase of the present invention.
Figure 4:
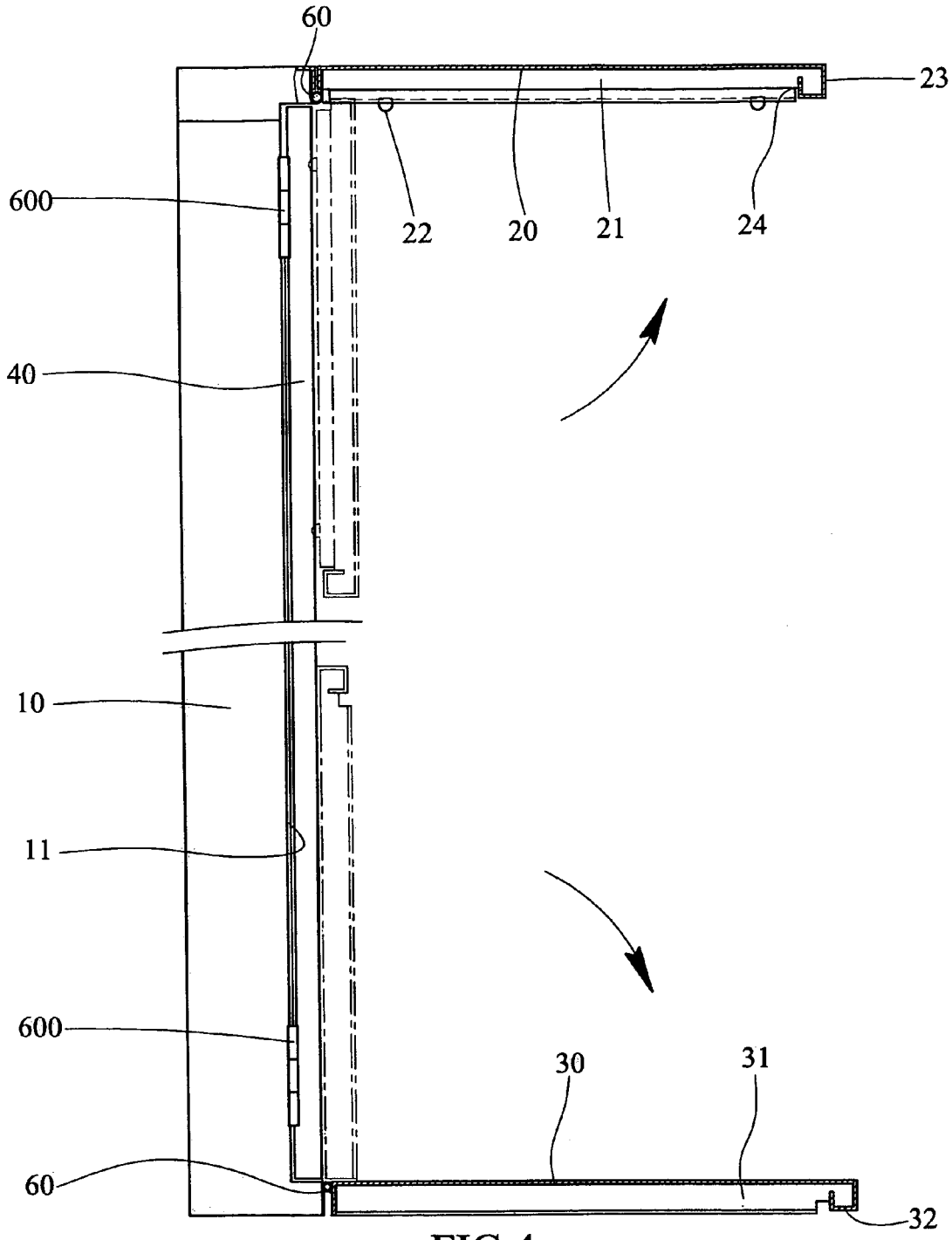
FIG. 4 shows the top board and the bottom board are pivoted about the frame.
Figure 5:
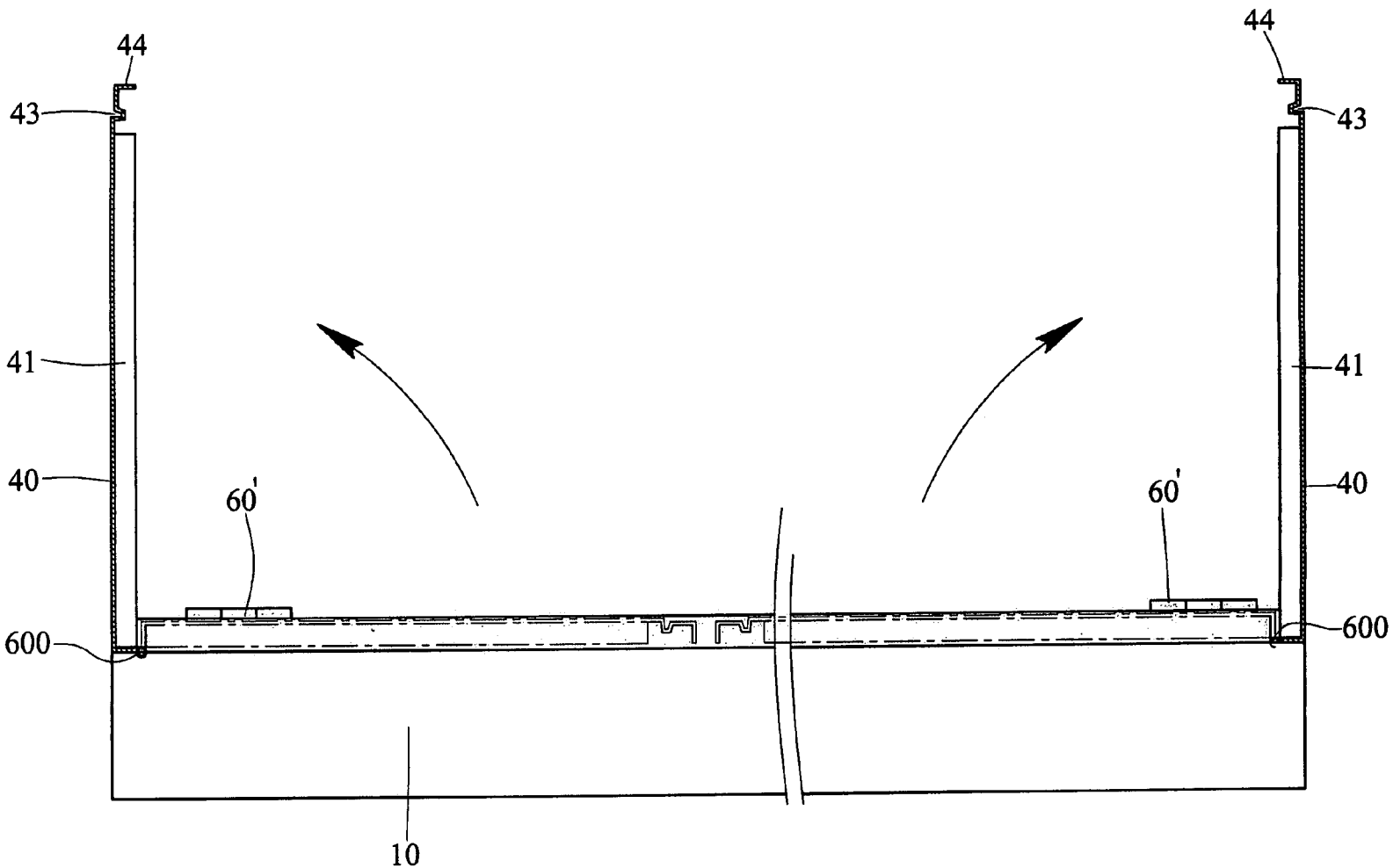
FIG. 5 shows the two sidewalls pivoted about the frame.

Referring to FIGS. 1 to 5, the foldable bookcase of the present invention comprises a rectangular front frame 10 including four sides 11 which are a top side, a bottom side and two vertical sides connected between the top side and the bottom side. A top board 20 has a first edge plate 21 bent from a front side and two ends of the top board 20 and a first connection portion 23 is bent from a rear side of the top board 20. The front side of the top board 20 is pivotably connected to the top side of the frame 10 by three first pivotable members 60 and pins. At least one boss 22 extends from the first edge plate 21 on each of the two ends of the top board 20 and a first through hole 24 is defined through the first connection portion 23.

A bottom board 30 has a second edge plate 31 bent from a front side and two ends of the bottom board 30 and a second connection portion 32 is bent from a rear side of the bottom board 30. The front side of the bottom board 30 is pivotably connected to the bottom side of the frame 10 by three second pivotable members 60' and pins.

Figure 7:
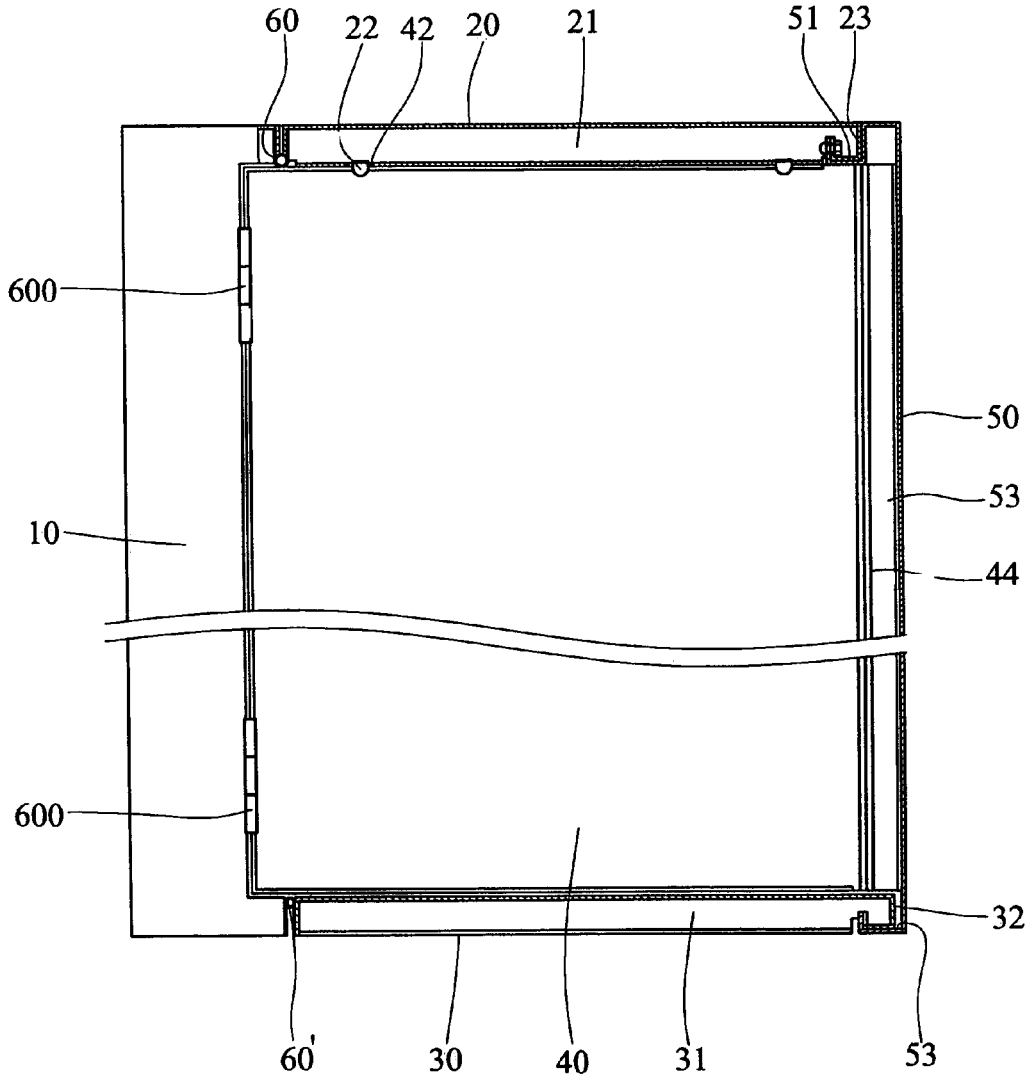
FIG. 7 shows the side cross sectional view of the bookcase of the present invention.

Two sidewalls 40 each have a bent plate 41 extending from a top side, a front side and a bottom side thereof. The two respective front sides of the two sidewalls 40 are pivotably connected to the two vertical sides of the frame 10 by two third pivotable members 600 and pins. An L-shaped bent edge 44 is defined in a rear side of each of the sidewalls 40 and includes a groove 43. The bent plate 41 on the top side of each of the sidewalls 40 includes a hole 42 so that the bosses 22 on the top board 20 are engaged with the holes 42 to connect the top board 20 to the two sidewalls 40 as shown in FIGS. 1-1 and 7.

Figures 1, 6:
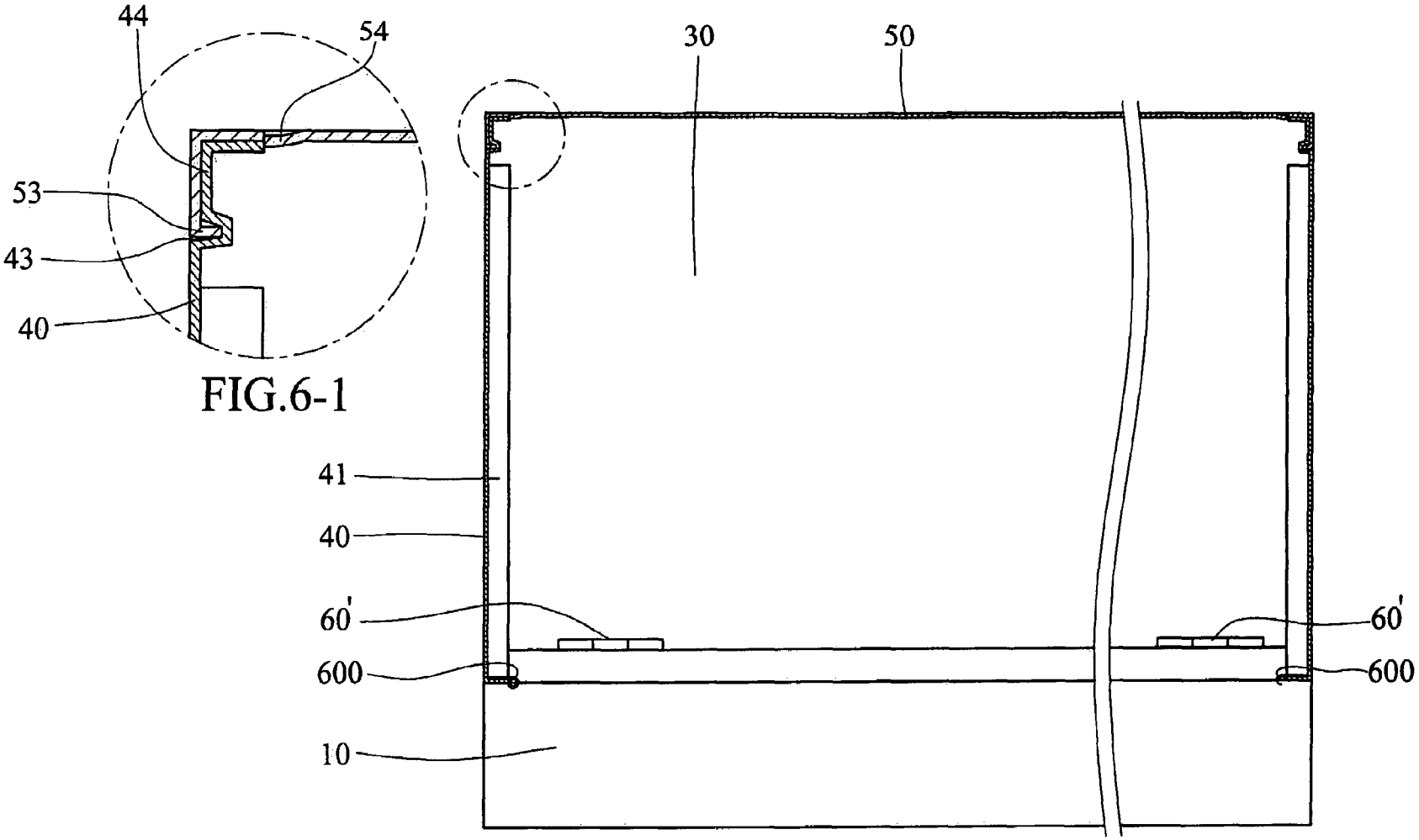
FIG. 6 shows the a top cross sectional view of the bookcase of the present invention.

A rear board 50 has an inward bent L-shaped connection portion 51 on a top side thereof and an insertion 53 extends from a bottom side and two vertical sides of the rear board 50. The L-shaped connection portion 51 of the rear board 50 includes a second through hole 52 and the L-shaped connection portion 51 is connected to the a first connection portion 23 of the top board 20 by extending a bolt through the first and second through holes 24, 52. The insertion 53 on the bottom side and the two vertical sides of the rear board 50 are respectively connected to the bottom side of the frame 10 and the two grooves 43 of the two sidewalls 40 as shown in FIGS. 6 and 6-1. Two stops 54 extend from an inside of the rear board 50 so as to stop two respective distal ends of the L-shaped bent edge 44 of the sidewalls 40 as shown in FIGS. 6 and 6-1.

Figure 8:
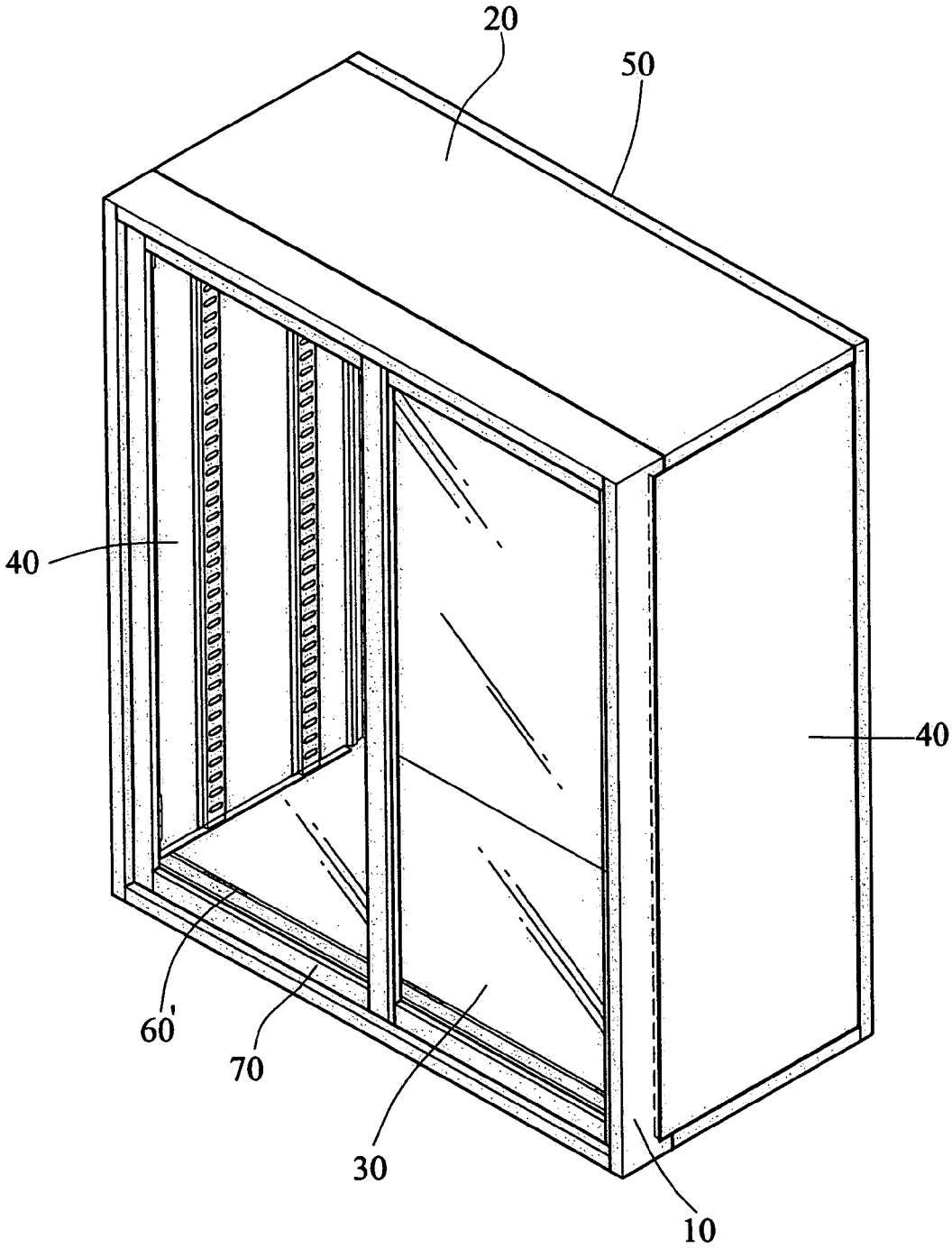
FIG. 8 shows the bookcase of the present invention equipped with two doors.
Figure 9:
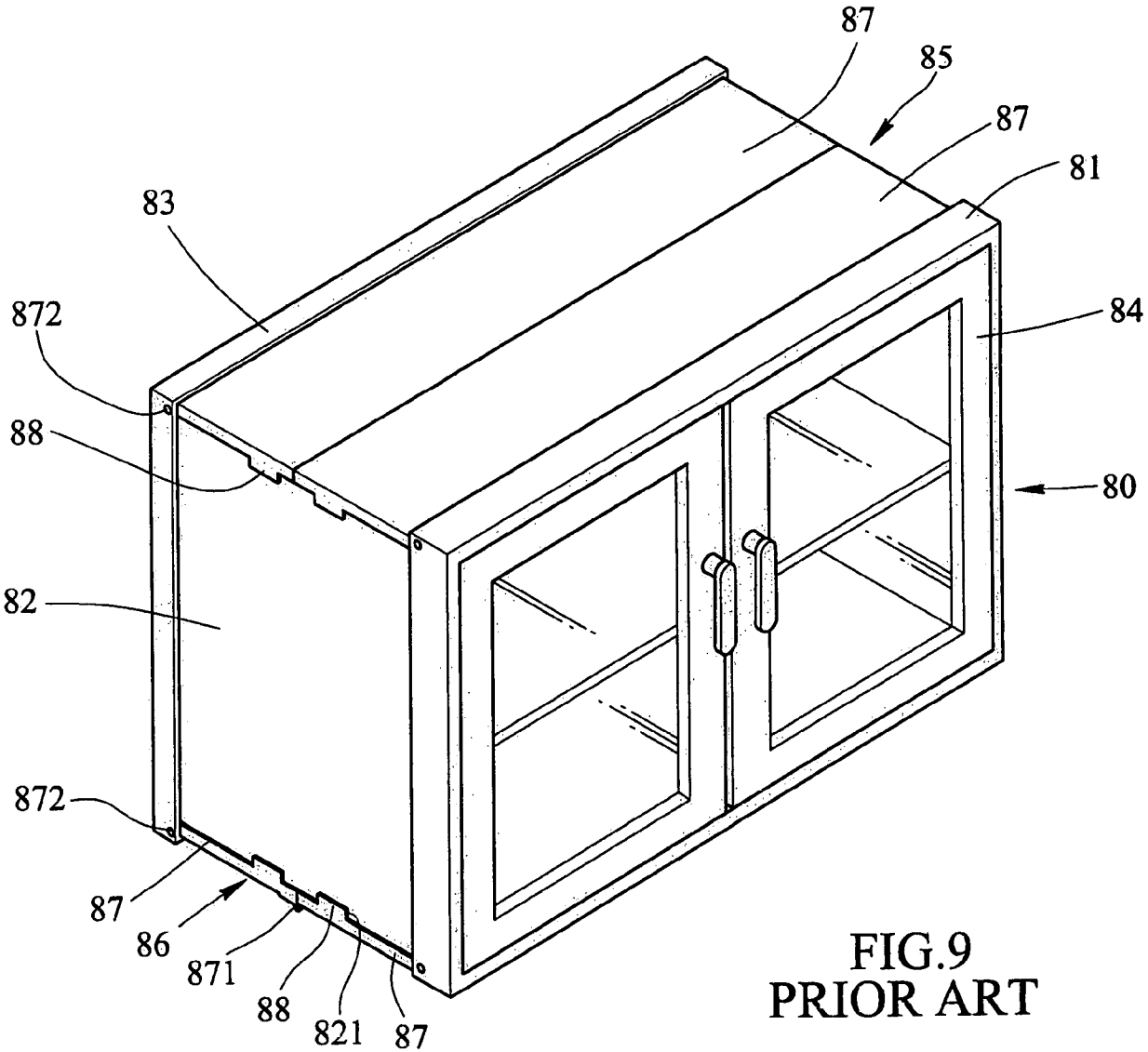
FIG.9 PRIOR ART
FIG. 9 is a perspective view of a conventional bookcase.
Figure 10:
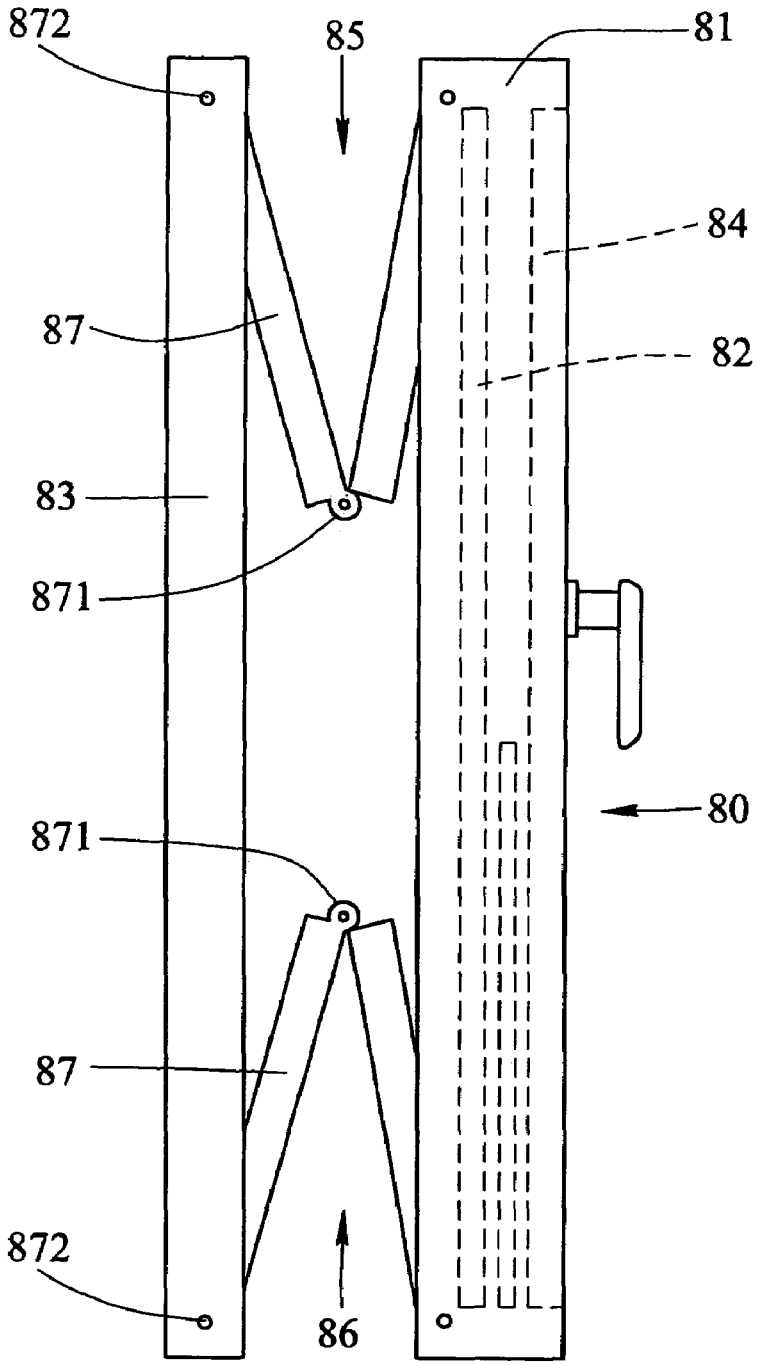
FIG.10 PRIOR ART
FIG. 10 shows the folded status of the conventional bookcase.

As shown in FIG. 8, the bookcase of the present invention may be equipped with two sliding doors 70 which are movably engaged with rails connected to the front frame 10.

The bookcase can be easily assembled and the two sidewalls 40 are quickly positioned relative to the top board 20 by the bosses 22 and the holes 42. The top board 20, the bottom board 30 and the two sidewalls 40 are able to be pivoted relative to the frame 10 so as to become a thin combination which is benefit for storage and transportation. The pivotable members are not seen from outside of the bookcase so that the bookcase has smooth outer appearance.

While we have shown and described the embodiment in accordance with the present invention, it should be clear to those skilled in the art that further embodiments may be made without departing from the scope of the present invention.

What is claimed is:

1. A foldable bookcase comprising:

a frame including four sides which includes a top side, a bottom side and two vertical sides connected between the top side and the bottom side;

a top board having a first edge plate bent from a front side and two ends of the top board and a first connection portion bent from a rear side of the top board, the front side of the top board pivotably connected to the top side of the frame by first pivotable members;

a bottom board having a second edge plate bent from a front side and two ends of the bottom board and a second connection portion bent from a rear side of the bottom board, the front side of the bottom board pivotably connected to the bottom side of the frame by second pivotable members;

two sidewalls each having a bent plate extending from a top side, a front side and a bottom side thereof, the two respective front sides of the two sidewalls pivotably connected to the two vertical sides of the frame by third pivotable members, an L-shaped bent edge defined in a rear side of each of the sidewalls and including a groove, and a rear board having an inward bent L-shaped connection portion on a top side thereof and an insertion extending from a bottom side and two vertical sides of the rear board, the L-shaped connection portion of the rear board connected to the a first connection portion of the top board and the insertion on the bottom side and the two vertical sides of the rear board respectively connected to the bottom side of the frame and the two grooves of the two sidewalls.

2. The bookcase as claimed in claim 1, wherein at least one boss extends from the first edge plate on each of the two ends of the top board and the bent plate on the top side of each of the sidewalls includes at least one hole so that the bosses are engaged with the holes.

3. The bookcase as claimed in claim 1, wherein two stops extend from an inside of the rear board so as to stop two respective distal ends of the L-shaped bent edge of the sidewalls.

4. The bookcase as claimed in claim 1, wherein the inward bent L-shaped connection portion on the top side of the rear board is connected to the first connection portion bent from the rear side of the top board by a bolt.

* * * * *